US007468402B2

(12) United States Patent
Yang et al.

(10) Patent No.: US 7,468,402 B2
(45) Date of Patent: Dec. 23, 2008

(54) POLYMERIC NANOEMULSION AS DRAG REDUCER FOR MULTIPHASE FLOW

(75) Inventors: Jiang Yang, Missouri City, TX (US); Steven Jeremy Weghorn, Missouri City, TX (US)

(73) Assignee: Baker Hughes Incorporated, Houston, TX (US)

( * ) Notice: Subject to any disclaimer, the term of this patent is extended or adjusted under 35 U.S.C. 154(b) by 614 days.

(21) Appl. No.: 11/068,400

(22) Filed: Feb. 28, 2005

(65) Prior Publication Data

US 2005/0209368 A1 Sep. 22, 2005

Related U.S. Application Data

(60) Provisional application No. 60/554,011, filed on Mar. 17, 2004.

(51) Int. Cl.
*B05D 5/08* (2006.01)

(52) U.S. Cl. ..... 523/175

(58) Field of Classification Search ..... 523/175
See application file for complete search history.

(56) References Cited

U.S. PATENT DOCUMENTS 3,736,288 A 5/1973 Stratta et al.
5,027,843 A 7/1991 Grabois et al.
2003/0134755 A1 7/2003 Martin

FOREIGN PATENT DOCUMENTS

CA 1309653 11/1992
CA 2247100 9/1997
EP 1 063 280 A1 12/2000
WO PCT/US2005/007431 6/2005

*Primary Examiner*—Edward J Cain
(74) *Attorney, Agent, or Firm*—Madan Mossman & Sriram PC

(57) ABSTRACT

Polymeric nanoemulsions facilitate flow and reduce drag and friction in multiphase pipelines containing both oil and water (e.g., oil/water, oil/water/gas, oil/water/solids, and oil/water/gas/solids) such as are used for oil or gas production, gathering, and transmission; hydrotransport of oilsand or heavy oil slurries and the like. Specific examples of suitable drag reducing polymers include polyacrylamide. The emulsions have a hydrocarbon external phase, droplets of an aqueous internal phase having water-soluble polymer dissolved therein, where the droplets have an average particle size below about 200 nm, and at least one surfactant to form a stable nanoemulsion. The nanoemulsions advantageously have a low viscosity of about 200 cP or less.

20 Claims, No Drawings

POLYMERIC NANOEMULSION AS DRAG REDUCER FOR MULTIPHASE FLOW

CROSS-REFERENCE TO RELATED APPLICATION

This application claims the benefit of U.S. Provisional Application No. 60/554,011 filed Mar. 17, 2004.

FIELD OF THE INVENTION

The invention relates to agents to be added to fluids flowing through a conduit to reduce the drag therethrough, and most particularly relates, in one non-limiting embodiment, to polymeric drag reducing agents (DRAs) for liquids such as mixtures and emulsions of water and hydrocarbons, where the agents are nanoemulsions.

BACKGROUND OF THE INVENTION

The use of polyalpha-olefins or copolymers thereof to reduce the drag of a hydrocarbon flowing through a conduit, and hence the energy requirements for such fluid hydrocarbon transportation, is well known. These drag reducing agents or DRAs have taken various forms, including slurries of ground polymer particulates and gels. A problem generally experienced with simply grinding the polyalpha-olefins (PAOs) is that the particles will "cold flow" or stick together after a relatively short time, thus making it impossible to place the PAO in the hydrocarbon in a form that will dissolve or otherwise mix with the hydrocarbon in an efficient manner. Further, the grinding process irreversibly degrades the polymer, thereby reducing the drag reduction efficiency of the polymer.

One common solution to preventing cold flow is to coat the ground polymer particles with an anti-agglomerating agent. Cryogenic grinding of the polymers to produce the particles prior to or simultaneously with coating with an anti-agglomerating agent has also been used. However, some powdered or particulate DRA slurries require special equipment for preparation, storage and injection into a conduit to ensure that the DRA is completely dissolved in the hydrocarbon stream.

Gel or solution DRAs have also been tried in the past. However, these drag reducing gels also demand specialized injection equipment, as well as pressurized delivery systems. They are also limited to about 10% polymer as a maximum concentration in a carrier fluid due to the high solution viscosity of these DRAs. Thus, transportation costs of the DRA are considerable, since up to about 90% of the volume being transported and handled is inert material.

Further, as noted, some polymeric DRAs additionally suffer from the problem that the high molecular weight polymer molecules can be irreversibly degraded (reduced in size and thus effectiveness) when subjected to conditions of high shear, such as when they pass through a pump. Additionally, some polymeric DRAs can cause undesirable changes in emulsion or fluid quality, or cause foaming problems when used to reduce the drag of multiphase liquids.

Surfactants, such as quaternary ammonium salt cationic surfactants, are known drag reducing agents in aqueous (non-hydrocarbon) systems and have the advantage over polymeric DRAs in that they do not degrade irreversibly when sheared. In contrast, flow-induced structures in surfactant solutions are reversible. However, the use of significant amounts of a surfactant in reducing the drag of mixed flow fluids such as the mixture of hydrocarbons and water can have the undesired side effect of creating a tight emulsion during flow that must be resolved downstream. Other drag reducing agents have tendencies to form deleterious emulsions, or perpetuate emulsions already formed.

Further, water soluble polymers have been used to increase water throughput in single phase processes such as waterfloods for enhanced oil recovery. However, unlike such single phase systems, most oil and gas production systems contain multiple phases (e.g., water/oil, water/oil/gas). These multiphase systems are often limited in their production capacity due to friction-related or flow-regime-related losses. In subsea multiphase pipelines, delivering active materials that can increase production is made difficult by the rigorous requirements that must be met by the chemical that is to be delivered. That is, products must not be too viscous to be pumped or be susceptible to physical separation that can lead to blockages in the umbilical conduits used to deliver chemicals. It is known that conventional water soluble emulsion polymers have viscosities that are too high for umbilical injection and they tend to phase separate during storage.

Thus, it would be desirable if a drag reducing agent could be developed which rapidly dissolves in the flowing hydrocarbon mixture or emulsion, which could minimize or eliminate the need for special equipment for preparation and incorporation of the agent into the hydrocarbon mixture or emulsion, and which could avoid shear degradation during its production and injection. It would also be desirable to find a water-soluble drag reducing agent that has a relatively low viscosity and which can be readily pumped, and which is stable during storage.

SUMMARY OF THE INVENTION

An object of the invention is to provide an additive that provides a reduction in pressure drop and/or an increase in flow in water-containing gas and oil multiphase production flowlines and transmission lines, as well as in water transmission lines.

Other objects of the invention include providing a DRA that can be readily manufactured and which does not require special equipment for placement in a conduit transporting hydrocarbon and water mixtures/emulsions or other fluids.

Another object of the invention is to provide a DRA that is storage stable and has a relatively low viscosity that enables it to be easily pumped.

In carrying out these and other objects of the invention, there is provided, in one form, a method of reducing drag of a fluid that involves providing the fluid which can be water; mixtures of hydrocarbons and water; mixtures of hydrocarbons, water and gas; mixtures of hydrocarbons, water and solids; mixtures of hydrocarbons, water, gas and solids; mixtures of water, gas, and solids; and mixtures of water and solids. A polymeric nanoemulsion drag reducer is added to the fluid in an amount effective to reduce the drag thereof. The polymeric nanoemulsion drag reducer may include a hydrocarbon external phase, droplets of water-soluble polymer dissolved in an aqueous internal phase, and at least one surfactant of a kind and amount effective to form a stable nanoemulsion of the water-soluble polymer droplets in the hydrocarbon external phase. The droplets have an average particle size below 200 nm.

There is also provided, in another non-limiting form, a reduced-drag fluid that may be water; mixtures of hydrocarbons and water; mixtures of hydrocarbons, water and gas;

mixtures of hydrocarbons, water and solids; mixtures of hydrocarbons, water, gas and solids; mixtures of water, gas, and solids; and mixtures of water and solids. Present in the fluid is a polymeric nanoemulsion drag reducer in an amount effective to reduce the drag of the fluid. The polymeric nanoemulsion drag reducer again includes a hydrocarbon external phase, droplets of water-soluble polymer dissolved in an aqueous internal phase, and at least one surfactant of a kind and amount effective to form a stable nanoemulsion of the water-soluble polymer droplets in the hydrocarbon external phase. The droplets of the aqueous phase containing the water-soluble polymer have an average particle size below 200 nm.

DETAILED DESCRIPTION OF THE INVENTION

As mentioned, it is known that conventional water soluble emulsion polymers have viscosities that are too high for umbilical injection and have the additional tendency to phase separate during storage. However, water soluble nano-emulsified polymers have been discovered to satisfy the rigorous requirements for umbilical injection and are storage-stable and have low viscosity. Specifically, this class of products has a viscosity of less than 200 centipoise (200 mPa-s) across a range of field-relevant temperatures (about 40 to about 140° F.; about 4 to about 60° C.) and exhibits long term static storage stability in that same temperature range. This class of nanoemulsion polymer has further been discovered to be effective in reducing the differential pressure and increasing the flow rate in water/hydrocarbon multiphase flow.

Many oil and gas production and flow lines contain significant levels of water in the liquid phase. As previously noted, the prior art describes the use of water soluble polymers as drag reducing agents in single phase aqueous systems such as in water flood applications in oil and gas production system, and multiphase oil/water systems. However, conventional polyacrylamide emulsions have untenably high viscosity and they are susceptible to phase separation during storage. Hence, they are unsuitable for umbilical and capillary applications which require low viscosity and high stability in the temperature range from about 40 to about 140° F. (about 4 to about 60° C.).

We have discovered a class of nanoemulsified water soluble polymers that exhibits the requisite low viscosity and storage stability for use in umbilical applications to subsea pipelines. Conventional water soluble emulsion polymers have viscosities greater than 1000 centipoise (1000 mPa-s), have particle sizes larger than 1 micron, and are only kinetically stable (i.e., they will separate with time). The nanoemulsions used as herein described have particle sizes below 200 nm, are thermodynamically stable, and thus will not separate with time. The nanoemulsions are visually clear and have viscosities less than 200 centipoise (200 mPa-s), well within the acceptable range for umbilical application. In another non-limiting embodiment, the nanoemulsions have viscosities less than 100 centipoise (100 mPa-s).

The nanoemulsions of water soluble polymer products used herein have the following composition:

a) Hydrocarbon external phase;
b) Nanometer-size aqueous internal phase droplets having dissolved therein water soluble polymer; and
c) At least one surfactant.

The hydrocarbon external phase can be mineral oil, mineral spirits, or other combinations of straight, branched, alicyclic, or aromatic hydrocarbons. In one non-limiting embodiment of the invention, the hydrocarbons in the external phase have from about 7 to about 18 carbon atoms. Mineral oils are defined herein as light hydrocarbon oils that are petroleum distillates. The amount of hydrocarbon can be from about 20 wt% to about 70 wt%, and in another non-limiting embodiment of the nanoemulsion range from about 20 wt% to about 50 wt%.

The polymer is present in the nanoemulsion in the range from about 15 wt% to about 70 wt%, and in an alternate non-limiting embodiment from about 15 wt% to about 50 wt%. The average size of the polymer droplets is below about 300 nm, alternatively below about 200 nm and in another non-limiting embodiment below about 150 nm. The polymer can be a polyacrylamide, polyacrylic acid or copolymers of polyacrylic acid, polyethylene oxide, guar, hydroxyethyl cellulose, polyvinyl alcohol and the like. The polymer backbone can be nonionic, cationic modified, or anionic modified. The molecular weight is larger than about 1 million mass units in one non-limiting embodiment of the invention, and alternatively is larger than about 2 million mass units.

The percentage of water in the internal, aqueous phase may be from about 10% to about 60%, and in an alternate, non-limiting embodiment of the invention, from about 10% to about 40%.

Surfactants are used to stabilize the nanoemulsions used in the present nanoemulsion. The amount of surfactants can be varied from about 2% to 30%, and in one non-limiting embodiment from about 3% to 20%. In general, the type of surfactants can be anionic, cationic, amphoteric or nonionic, or a combination of thereof. Surfactants should generally have low HLB (hydrophilic and lipophilic balance) values that favor water in oil emulsions, for instance less than about 8, and in another non-limiting embodiment has an HLB of less than about 7. In one non-limiting embodiment of the invention the lower threshold of the HLB range is about 3. These levels of surfactants are not so high as would be expected to cause stable emulsions in the water/hydrocarbon fluids being treated with drag reducers.

Specific, suitable nonionic surfactants include, but are not necessarily limited to, alkoxylated alcohols or ethers; alkyl ethoxylates; alkylamido ethoxylates; alkyl glucosides; alkoxylated carboxylic acids; sorbitan derivatives where the alkyl chain length varies from 8 to 24, etc, for example, nonylphenol ethoxylate-3; alkyl ethoxylates-3; oleyl carboxylic diethylamides; and the like and mixtures thereof. The suitable surfactants and mixtures thereof include cationic surfactants such as, but are not necessarily limited to, monoalkyl quaternary amines, such as cocotrimonium chloride; cetyltrimonium chloride; stearyltrimonium chloride; soyatrimonium chloride; behentrimonium chloride; and the like and mixtures thereof. Other cationic surfactants that are useful may include, but are not necessarily limited to, dialkyl quaternary amines such as dicetyidimethyl ammonium chloride, dicocodimethyl ammonium chloride, distearyldimethyl ammonium chloride, and the like and mixtures thereof. Suitable surfactants and mixtures thereof include anionic surfactants such as, but are not necessarily limited to, fatty carboxylates, alkyl sarcosinates, alkyl phosphates, alkyl sulfonate, alkyl sulfates and the like and mixtures thereof. The amphoteric/zwitterionic surfactants that would be useful include, but are not necessarily limited to, alkyl betaines, alkylamido propyl betaines, alkylampho acetates, alkylamphopropionates, alkylamidopropyl hydroxysultanes and the like and mixtures thereof. Fatty alcohols with chain length from C8 to C24 can be also used as cosurfactants. Polymeric surfactants can also be used such as the ones made by Uniqema in the Hypermere® surfactant series, as non-limiting examples.

The polymeric nanoemulsion drag reducers herein are generally made by combining the component parts with agitation and/or mixing sufficient to form water-soluble polymer/water droplets of acceptably small size. High shear conditions may also be used. Also, in general, more surfactant is used for nanoemulsions as compared with the conventional emulsions having much larger droplets or particles. The proper ratios of surfactant to water to hydrocarbon or oil should be used and, in one non-limiting embodiment may be the ones previously given. It is difficult to give exact ratios since the optimum ratios for the best polymeric nanoemulsion drag reducers of this invention will depend upon the nature of the polymeric drag reducer, the nature of the surfactant, the nature of the hydrocarbon, and the type and speed of the mixing or agitation process.

One non-limiting manner of practicing this invention is through continuous injection of the nanoemulsion polymer product through subsea umbilical into the multiphase flowlines in order to achieve increased production and/or reduction in pressure drop through the treated system. The reduction in pressure drop in a multiphase flowline is achieved by modifying the flow regime in the water/hydrocarbon system and/or minimizing turbulence, and thereby friction, in the aqueous phase. It is difficult to predict in advance what an effective use concentration should be because such concentration is dependent upon many interrelated variables in the system being treated, including, but not necessarily limited to, temperature, water cut, fluid velocity, the nature of the hydrocarbon, the nature of the polymeric nanoemulsion drag reducer, etc. Nevertheless, to give some sense of typical concentrations that might be used, one non-limiting effective use concentration range is 1 to 1000 ppm as product of water soluble polymer to the fluid. In another non-limiting embodiment of the invention, the lower threshold of the concentration range is at about 30 ppm, where the upper threshold of the concentration range may be up to about 300 ppm, alternatively up to 100 ppm of nanoemulsion product based on the total fluid treated.

Multiphase oil and gas pipelines (e.g., oil/water, oil/water/gas, oil/water/solids) such as are used for oil or gas production and gathering, and gas gathering and transmission lines (e.g., gas/condensate/water and oil/water/gas/solids), for hydrotransport of oilsand or heavy oil slurries, or evacuation of oily waste sludge from ponds and pits are systems that can benefit from using the polymeric nano-emulsion drag reducers of this invention. It has been discovered in one non-limiting embodiment that polyacrylamides that contain anionicity in the polymer backbone enjoy the distinct advantage of exhibiting substantially lower emulsion creating tendency as compared with their cationically or neutrally modified congeners.

As noted, the use of polyacrylamide as drag reducing agents in single phase aqueous systems in prior methods such as in water flood applications in oil and gas production is known. In contrast, the use of polyacrylamides for improving fluid flow properties in multiphase systems, (e.g. water-oil, water-oil-gas) has received relatively little or no attention, and has certainly not achieved a level sufficient for commercial applications of any use.

The present invention additionally relates to methods and compositions for reducing drag and improving flow in turbulent multiphase hydrocarbon systems with little or no substantial change in the bulk fluid viscosity of the multiphase system. Hydrocarbon systems include, but are not necessarily limited to, any flowing stream that has at least 0.5% of hydrocarbon component in it. Hydrocarbon systems include, but are not necessarily limited to, multiphase flowlines (for example oil/water, oil/water/gas) in oil and gas production systems. It will be appreciated that by the term "hydrocarbon fluid", it is expected that oxygenated or nitrogenated hydrocarbons such as lower alcohols, glycols, amines, ethers, and the like may be included within the definition. The term "hydrocarbon fluid" also means any fluid that contains hydrocarbons, as defined herein to also include oxygenated hydrocarbons. Thus, multiphase hydrocarbon-containing systems (e.g. oil/water, oil/water/gas), such as oil and gas production flowlines are primary applications for this technology. Conventional polymeric-based drag reducers (e.g. poly(alpha-olefins)) are generally not suitable for these applications either because of their high intrinsic viscosity and/or system fluid incompatibility.

Multiphase oil pipelines (e.g., oil/water, oil/water/gas) and gas gathering and transmission lines (e.g., gas/condensate/water, gas/oil/water) are systems that can benefit from using suitable polymers that bear an anionic charge in the polymer backbone and/or the polymeric nanoemulsion drag reducers of this invention. In one non-limiting embodiment of the invention, suitable polymers include, but are not limited to, anionic polymers of acrylic or methacrylic alkylene esters or amides of trialkyl or alkylaryl ammonium salts; vinyl or allyl trialkyl or alkylaryl, or diallyl dialkyl or alkylaryl ammonium salts; and co-polymers of these with nonionic acrylic or methacrylic esters, amides, or nitrites; or vinyl alcohols, esters, and amides; and combinations thereof. Methods of producing hydrophilic polymers are well known and include, but are not necessarily limited to, incorporating into the polymer, at its inception or later, at least some monomers which dissociate at the system pH, at least to some extent, to an incorporated monomeric anion and an unincorporated, labile, dissolved cation. The anionic monomers may be included in the mix of monomers being polymerized, or they may be created by reaction with originally non-ionic or even cationic monomers post-polymerization. For example, the anionic acrylic monomer sodium acrylate can be homopolymerized, or mixed with the non-ionic acrylic monomer acrylamide and copolymerized, randomly or in blocks, via induction with and propagation of free radicals in aqueous or saline solution; or the acrylamide alone can be homopolymerized in said manner and then reacted with sodium hydroxide to create a homopolymer of sodium acrylate or copolymer of sodium acrylate and acrylamide. Typical free radical polymerization initiators include thermally homolytic peroxides and azo compounds and redox pairs. The polymerization may be carried out in free liquid or in droplets dispersed in oil. Post-polymerization, the aqueous solvent can be left in to form a viscous dilute solution, dispersion in brine, or emulsion in oil; or removed to form a powder, or a dispersion in oil.

The hydrophilicity may be present in the monomer prior to polymerization, as in acrylamide, or may be created after polymerization, as when lipophilic vinyl acetate is polymerized (or copolymerized), then reacted with sodium hydroxide to hydrophilic (but nonionic) poly(vinyl alcohol) and an acetate anion.

The high MW of the water-soluble polymers may be the result of an original polymerization, or of a secondary crosslinking, via mutually reactive end or pendant groups or intermediates, of lower MW polymers or oligomers.

In one non-limiting embodiment of the invention, the molecular weight of the polymer ranges from about 1 MD to about 30 MD average molecular weight. In another, alternate embodiment of the invention, the molecular weight of the polymer ranges from about 5 MD to about 20 MD.

Many oil and gas production systems (e.g. those that transport and produce gas and oil from deep water reservoirs in the Gulf of Mexico and elsewhere) are limited in their production due to pressure drop in the flowlines under "turbulent" or intermittent flow regime. The drag reducing methods of the invention comprise applying additives to the system by continuous treatments at high enough concentrations to produce the desired reduction in drag and/or increase in flow for the same amount of motive energy. The compositions containing the additive are used effectively by maintaining drag reduction effectiveness over an extended period of time.

In another non-limiting embodiment of the invention, the drag reducing additives are employed in the absence of any other drag reducing additive, i.e. one that does not fall within the definitions of this invention. On the other hand, there may be situations or environments where it is advantageous to employ other drag reducing additives together with those of this invention in effective mixtures, such mixtures being within the bounds of this invention. For instance, such mixtures may be helpful in spreading the drag reduction effects of the additives further over time and/or distance.

Other suitable additives that may also be included with the polymeric nano-emulsion drag reducers of the invention include amine-based and non-amine based corrosion inhibitors, such as imidazolines, amides, fatty acid-based inhibitors, phosphate esters etc.; non-amine based biocides, such as acrolein; non-amine based gas hydrate inhibitors, such as nonionic antiagglomerants and kinetic inhibitors; scale inhibitors, and the like.

To further illustrate the invention, the inventive method will be additionally described by way of the following non-limiting Examples, which are intended only to further show specific embodiments of the invention.

EXAMPLES 1-4

The viscosity of conventional polyacrylamide emulsion 1, emulsion 2 and polyacrylamide nanoemulsion 3 and 4, is as shown in the following Table I at 25° C.:

TABLE I

Comparison of Viscosities of Conventional and Inventive Emulsions

| Shear rate, (1/s) | Comparative Emulsion 1 | Comparative Emulsion 2 | Inventive Nanoemulsion 3 | Inventive Nanoemulsion 4 |
|---|---|---|---|---|
| 0.5 | 5900 cp | 9000 cp | 43 cp | 50 cp |
| 1 | 3800 cp | 6000 cp | 39 cp | 48 cp |
| 10 | 1200 cp | 1200 cp | 39 cp | 48 cp |
| 100 | 580 cp | 250 cp | 37 cp | 48 cp |

Viscosities were measured with parallel plate on a Rheometric SR 5000 dynamic rheometer.
Note:
These parameters have the same values if expressed in SI terms of mPa-s.

It can be seen from Table I that a significantly lower viscosity fluid was obtained with inventive polyacrylamide nanoemulsions 3 and 4, especially at low shear rates. This is most important with respect to injection pump start up for umbilical and capillary applications.

EXAMPLES 5-8

The stability of conventional polyacrylamide emulsions 1 and 2, as well as polyacrylamide nanoemulsions 3 and 4 are as shown in Table II as a percentage of separation after 6 months:

TABLE II

Comparison of Stabilities of Conventional and Inventive Emulsions

| | | Ex. | | | |
|---|---|---|---|---|---|
| Test time | Temp. | 5 Comparative Emulsion 1 | 6 Comparative Emulsion 2 | 7 Inventive Nanoemulsion 3 | 8 Inventive Nanoemulsion 4 |
| 6 mo. | 25° C. | 10% oil separates | 10% oil separates | 0% oil separates | 0% oil separates |
| 6 mo. | 45° C. | 15% oil separates | 15% oil separates | 0% oil separates | 0% oil separates |
| 1 wk. | 65° C. | 10% oil separates | 10% oil separates | 0% oil separates | 0% oil separates |

Importantly, no separation was seen in inventive polyacrylamide nanoemulsions 3 or 4 while the two conventional emulsions (1 and 2) show significant degrees of separation.

EXAMPLE 9

Drag reduction performance was evaluated via a torque testing apparatus. The evaluations were carried out in a 100 ml glass cell. Inside the glass cylinder containing the fluid an aluminum cylinder spun at a constant rate. The effective fluid layer is 2 mm thick. The cylinder is attached to a torque meter, which sends an analog voltage through a frequency filter where the signal is converted to a digital signal that is logged into the computer. In the test the polyacrylamide nanoemulsion was added using a micro-syringe. All tests were carried out in water at 22° C.

Percent drag reduction for a particular DRA/water system in the torque test was calculated by using the formula:

$$DR\ \% = 100 \times \frac{(Torque_{Sol} - Torque_{DRA})}{(Torque_{Sol} - Torque_{Air})}$$

where $Torque_{air}$, $Torque_{Sol}$ and $Torque_{DRA}$ are the torque values in air, solution without DRA and solution with DRA, respectively.

Drag reduction results for inventive polyacrylamide nanoemulsion 3 from 9 ppm to 36 ppm in water obtained in torque test are shown in Table III below.

TABLE III

Drag Reduction Using Inventive Nanoemulsion

| Concentration of PAM from Nanoemulsion 3 | DR % (Initial) | DR % (30 min) |
|---|---|---|
| 9 ppm | 9% | 13% |
| 18 ppm | 13% | 15% |
| 27 ppm | 17% | 18% |
| 36 ppm | 18% | 19% |

It may be seen from the results of Table III that the polyacrylamide nano-emulsion of this invention was an effective drag reduction agent.

EXAMPLE 10

A single pass flow apparatus was used to study multiphase flow. An isoparaffin oil, Isopar M from ExxonMobil, was used as the model oil phase. An oil and water mixture in various proportions ranging from 60/40 to 0/100 was charged into a 2 liter Parr vessel reservoir and mixed at 1000 rpm for 3 minutes. An inventive polyacrylamide nanoemulsion at 60 ppm concentration (active 15 ppm) was used (nanoemulsion 3). The oil/water mixture was discharged to the test section using nitrogen head pressure at 70 psi 0.48 MPa. The test section was 102 cm long and 0.44 cm in diameter. A differential pressure transducer was used to measure the pressure drop across the test section. A total of 1400 ml fluid was used in each test. Prior to collecting fluid, the loop was purged with the test fluid for 0.5 second in each test. The mass throughput of fluid was measured by discharging the fluid for 3 seconds. The results are listed in Table IV below.

TABLE IV

Drag Reduction in Multiphase Flow

| Water/Oil ratio (volume) | Throughput increase with nanoemulsion | Pressure drop decrease with nanoemulsion |
|---|---|---|
| 100/0 | 18.3% | 11.5% |
| 70/30 | 18.2% | 13.2% |
| 50/50 | 13% | 14.5% |
| 40/60 | 11% | 8.9% |

It can be seen from the results reported in Table IV that throughput of the multiphase fluid increased while a reduction in differential pressure was concomitantly realized.

Many modifications may be made in the composition and implementation of this invention without departing from the spirit and scope thereof that are defined only in the appended claims. For example, the exact drag reducing emulsion(s) and mixture having its friction properties modified may be different from those explicitly used here. Additionally, water-soluble, drag reducing polymers other than those specifically mentioned may find utility in the methods of this invention. Various combinations of water-soluble polymers, hydrocarbons and surfactants, besides those explicitly mentioned herein, and in different proportions than those mentioned herein, are also expected to find use as drag reducing agents.

We claim:

1. A method of reducing drag of a fluid comprising:

providing the fluid selected from the group consisting of water; mixtures of hydrocarbons and water; mixtures of hydrocarbons, water and gas; mixtures of hydrocarbons, water and solids; mixtures of hydrocarbons, water, gas and solids; mixtures of water, gas, and solids; and mixtures of water and solids; and adding a polymeric nanoemulsion drag reducer to the fluid in an amount effective to reduce the drag thereof, where the polymeric nanoemulsion drag reducer comprises:

a hydrocarbon external phase, droplets of an aqueous internal phase having water-soluble polymer dissolved therein, where the droplets have an average particle size below 300 nm, and at least one surfactant of a kind and amount effective to form a stable nanoemulsion of the droplets in the hydrocarbon external phase.

2. The Method of claim 1 where the water-soluble polymer is selected from the group consisting of polyacrylamides, polyacrylic acids or copolymers of polyacrylic acid, polyethylene oxides, guars, hydroxyethyl celluloses, polyvinyl alcohols and mixtures thereof.

3. The mothed of claim 1 where the hydrocarbon external phase is selected from the group consisting of straight, branched, alicyclic, or aromatic hydrocarbons, mineral oils, mineral spirits, and mixtures thereof.

4. The method of claim 1 where the at least one surfactant has a low HLB of less than about 8.

5. The method of claim 1 where the concentration of the nanoemulsion in the fluid ranges from about 1 to about 1000 ppm.

6. The method of claim 1 where the nanoemulsion comprises:

from about 20 to about 70 wt% hydrocarbon external phase;

from about 15 to about 70 wt% water-soluble polymer;

from about 10 to about 60 wt% water; and from about 2 to about 30 wt% surfactant.

7. The method of claim 1 where the polymeric nanoemulsion drag reducer is continuously injected into the fluid.

8. The method of claim 1 where the polymeric nanoemulsion drag reducer has a viscosity of equal to or less than about 200 centipoise over the range of about 4 to about 60° C.

9. A method of reducing drag of a fluid comprising:

providing the fluid selected from the group consisting of water; mixtures of hydrocarbons and water; mixtures of hydrocarbons, water and gas; mixtures of hydrocarbons, water and solids; mixtures of hydrocarbons, water, gas and solids; mixtures of water, gas, and solids; and mixtures of water and solids; and adding a polymeric nanoemulsion drag reducer to the fluid in an amount effective to reduce the drag thereof, where the polymeric nanoemulsion drag reducer comprises:

a hydrocarbon external phase;

droplets of an aqueous internal phase having water-soluble polymer dissolved therein, where the droplets have an average particle size below 300 nm, where the water-soluble polymer is selected from the group consisting of polyacrylamides, polyacrylic acids or copolymers of polyacrylic acid, polyethylene oxides, guars, hydroxyethyl celluloses, polyvinyl alcohols and mixtures thereof; and at least one surf actant of a kind and amount effective to form a stable nanoemulsion of the droplets in the hydrocarbon external phase, where the surfactant has a low HLB of less than about 8.

10. The method of claim 9 where the hydrocarbon external phase is selected from the group consisting of straight, branched, alicyclic, or aromatic hydrocarbons, mineral oils, mineral spirits, and mixtures thereof.

11. The method of claim 9 where the concentration of the nanoemulsion in the fluid ranges from about 1 to about 1000 ppm.

12. The method of claim 9 where the nanoemulsion comprises:

from about 20 to about 70 wt% hydrocarbon external phase;

from about 15 to about 70 wt% water-soluble polymer;

from about 10 to about 60 wt% water; and from about 2 to about 30 wt% surf actant.

13. The method of claim 9 where the polymeric nanoemulsion drag reducer has a viscosity of equal to or less than about 200 centipoise over the range of about 4 to about 60° C.

14. A fluid having reduced drag comprising:

a fluid selected from the group consisting of water; mixtures of hydrocarbons and water; mixtures of hydrocarbons, water and gas; mixtures of hydrocarbons, water and solids; mixtures of hydrocarbons, water, gas and solids; mixtures of water, gas, and solids; and mixtures of water and solids; and a polymeric nanoemulsion drag reducer in an amount effective to reduce the drag of the fluid, where the polymeric nanoemulsion drag reducer comprises:

a hydrocarbon external phase, droplets of an aqueous internal phase having water-soluble polymer dissolved therein, where the droplets have an average particle size below 300 nm, and at least one surf actant of a kind and amount effective to form a stable nanoemulsion of the droplets in the hydrocarbon external phase.

15. The fluid of claim 14 where the water-soluble polymer is selected from the group consisting of polyacrylamides, polyacrylic acids or copolymers of polyacrylic acid, polyethylene oxides, guars, hydroxyethyl celluloses, polyvinyl alcohols and mixtures thereof.

16. The fluid of claim 14 where the hydrocarbon external phase is selected from the group consisting straight, branched, alicyclic, or aromatic hydrocarbons, mineral oils, mineral spirits, and mixtures thereof.

17. The fluid of claim 14 where the at least one surfactant has a low HLB of less than 8.

18. The fluid of claim 14 where the concentration of the nanoemulsion in the fluid ranges from about 1 to about 1000 ppm.

19. The fluid of claim 14 where the nanoemulsion comprises:

from about 20 to about 70 wt% hydrocarbon external phase;

from about 15 to about 70 wt% water-soluble polymer;

from about 10 to about 60 wt% water; and from about 2 to about 30 wt% surfactant.

20. The fluid of claim 14 where the polymeric nanoemulsion drag reducer has a viscosity of equal to or less than about 200 centipoise prior to being introduced into the fluid over the range of about 4 to about 60° C.

* * * * *